United States Patent [19]

Lindgren

[11] Patent Number: 4,509,297

[45] Date of Patent: Apr. 9, 1985

[54] SKI SHARPENER

[76] Inventor: Erik V. Lindgren, P1 1101, S-790 15 Sundborn, Sweden

[21] Appl. No.: 435,249

[22] Filed: Oct. 19, 1982

[30] Foreign Application Priority Data

Oct. 21, 1981 [SE] Sweden ..... 8106227

[51] Int. Cl.[3] ..... A63C 11/06; B23D 67/12

[52] U.S. Cl. ..... 51/181 R; 76/83

[58] Field of Search ..... 76/83, 88, 82, 82.1; 30/169, 172; 51/205 WG, 181 R; 280/809

[56] References Cited

U.S. PATENT DOCUMENTS

| | | | |
|---|---|---|---|
| 512,382 | 1/1894 | Knowles et al. | 76/83 |
| 2,756,499 | 7/1956 | Liesunaitis | 30/169 |
| 3,165,832 | 1/1965 | Stipcevich | 30/172 |
| 3,934,287 | 1/1976 | Howard | 30/172 |
| 4,089,076 | 5/1978 | Sparling | 30/172 |
| 4,189,874 | 2/1980 | Labriola | 76/83 |

*Primary Examiner*—Roscoe V. Parker

*Attorney, Agent, or Firm*—Bacon & Thomas

[57] ABSTRACT

A device for sharpening the edges and scraping the base of skis, comprising a substantially plate-shaped holder body, which one side thereof carries two parallel and spaced apart file blades arranged in the same plane, and which on the opposite side thereof carries a cutting blade arranged in the transverse direction of the file blades and substantially crosswise to the file plane, which cutting blade is adjustably arranged in the holder body, so that the distance of the cutting edge from the holder body can be varied along the cutting blade.

12 Claims, 6 Drawing Figures

SKI SHARPENER

Figure 1:
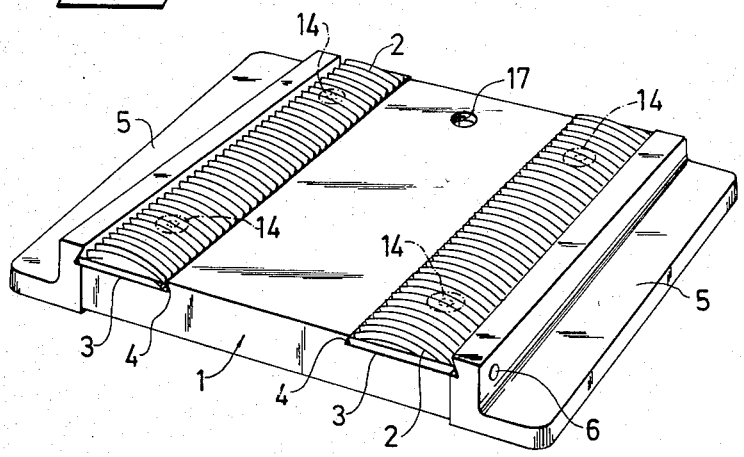

The present invention relates to a device for sharpening the edges and scraping or shaving the base of skis.

Downhill skis are provided with steel edges at the outer edge of the sliding surface in order to provide a better grip against the ground when the ski is inclined and pressed against the ground for being brought to turn. In case of a hard and icy ground it is especially important that the steel edges are sharp. After some time of running the sharpness of the steel edges is lost through damages and abrasion against a hard ground. Therefore, they must be sharpened now and then. This is usually done by means of a hand file, but it can also be done by machine aid. When sharpening manually a file blade of pansar blade type is normally used, which is held obliquely above the sliding surface and is drawn back and forth above the ski. The base between the steel edges is then abrased or scraped down to the level of the steel edges by means of a steel scraper or the like. In order that the file blade shall be effective it must be pressed against the steel edges. The file blade then easily forms an arch with the result that only the outer edges of the steel edges are sharpened. As a consequence the ski gets a convex sliding surface which makes turning more difficult in that the ski has time to slide too much before the steel edge enters the ground. A correct sharpening of the steel edges thus requires practice and skill and is time-consuming. Different devices have been provided for facilitating the sharpening operation by carrying the file blade in some kind of a holder. These devices are more and less sofisticated, and they can also comprise files for sharpening the side edges of the steel edges as well as means for guiding the holder against the ski edge. With these devices, as well as in sharpening by machine aids, it is relatively simple to obtain a flat-sharpened sliding surface which should be sufficient for the so-called ordinary downhill skier. For advanced skiers, and then in particular for elite skiers, other demands are put on the sharpening of the skis. Thus, the base on the front portion of the skis is usually scraped to a convex or planar shape, the portion under the foot to a planar or convex shape depending on the ski ground, and the rear portion of the ski normally to a planar shape. (It is here, of course, a question of very small variations in the planarity or flatness of the base of the order of magnitude of a couple of a hundreds to a couple of tens of a millimeter.) In order to be able to achieve this, one is normally referred to the above described hand file and a separate scraping tool with accompanying drawbacks as to demands on the skill of the person performing the sharpening and scraping operation and the time consumed.

This invention relates to a sharpening and scraping tool, by means of which the sliding surface of the ski in simple manner can be sharpened and smoothed to a desired shape which gives an excellent result also for an inexperienced person. The sharpening device according to the invention is also easy to make and permits a quick replacement of worn-out parts. Furthermore, by the construction thereof the risks of slipping and thereby damaging the base of the skis are minimized.

The sharpening device according to the invention comprises an essentially plate-shaped holder body on one side of which two parallel file blades are provided spaced apart from each other. This side is intended to be applied to the sliding surface of the ski with the file blades aligned with the longitudinal direction of the ski. The space between the file blades is adapted such that essentially only the steel edges are filed when the tool is brought back and forth along the ski. On the opposite side of the holder a cutting blade is arranged crosswise to the file plane and in the transverse direction of the file blades. This side is intended for scraping or shaving of the base between the steel edges, and the cutting blade is adjustably arranged in the holder body so that the shape or contour of the cutting edge can be varied in order to give a desired plane, convex, concave or possibly any other shape of the sliding surface of the ski.

The above mentioned holder, which suitably is provided with handles or thumb grips on the side edges along the file blades, can be designed in different ways and may, for example, consist of a frame structure. The portion carrying the file blades and the cutting blade is, however, preferably formed in a single piece. It is then preferably made of a relatively heavy material such as steel or cast iron, so that in use the file is pressed against the ski surface by its own weight, it thereby not being necessary to apply any significant pressure on the holder by means of the hands. The desired weight of the tool can, of course, also be obtained in other ways, for example by a box-shaped holder which is filled with sand or the like. If the holder consists of a frame structure a heavy element can be secured to the same in any suitable manner. The holder can be designed essentially in one piece or in several parts. Thus, e.g. the handles can be removable.

The file blades, which preferably are of the so-called pansar blade type, can be attached to the holder in different ways depending on the construction of the holder. When the holder comprises a plate the file blades may suitably be arranged in depressions in the plate and fixed either by countersunk screws or by each file blade being pressed or clamped against either side edge of the depression by suitable means. Thus, a simple way of fixing the blade files in a preferred holder embodiment having removable handles is to let the handles provide the outer side edge of said depressions and thereby secure the file blades in place when screwing the handles to the holder. Alternatively, the inner side edges of the depressions can be made removable, for example by making an upper part of the plate between the file blades removable and provided with an inwardly inclined side edge which is pressed against the file blade when said portion is screwed on. The file blades may, of course, also be fixed in the depressions by countersunk screws through the file blades.

The cutting blade or cutter for scraping or shaving the base can be fixed in the holder and be given the mentioned adjustability in different ways. In a simple and efficient embodiment the cutting blade is arranged in a groove in the holder and fixed by means of at least three horizontal screws suitably spaced along the cutting blade and extending through the holder to said groove and essentially perpendicularly to the cutting blade to press the same against one side of the groove or recess. The adjustment between planar and different arch shapes of the cutting edge can then be done by bending the cutting blade and fixing different portions thereof on different levels in the groove or recess. To facilitate said adjustment of the cutting blade in the groove at least one adjustable vertical screw may be arranged in the holder which extends in the direction of the groove and is capable of acting upon the lower edge of the cutting blade, thereby permitting raising or lowering of the respective portion of the cutting blade.

Figure 2:
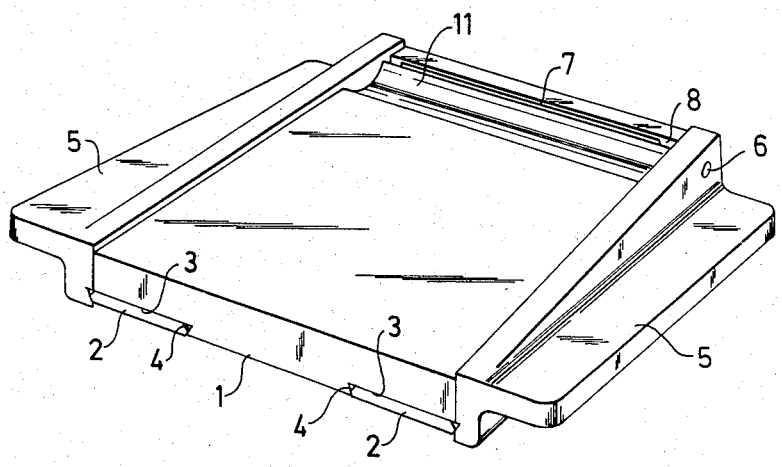
Figure 3:
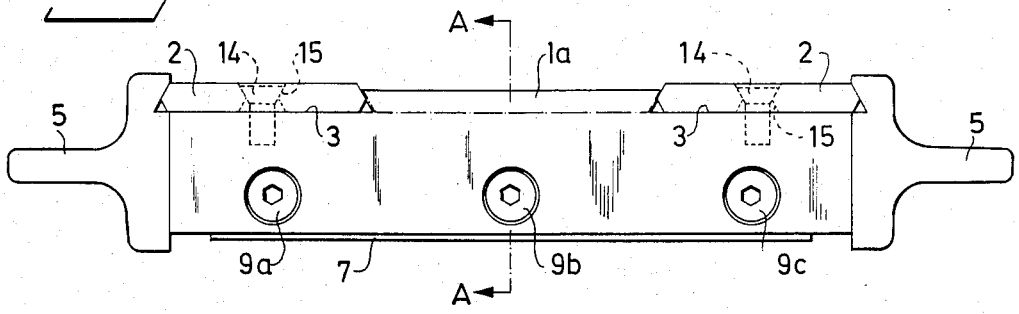
Figure 4:
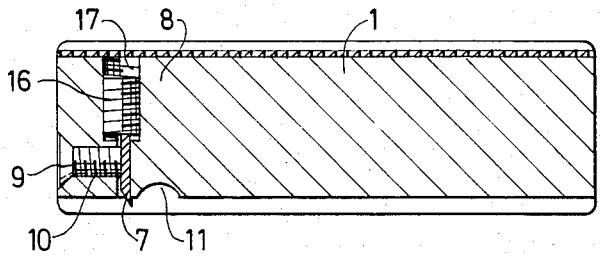
Figure 5:
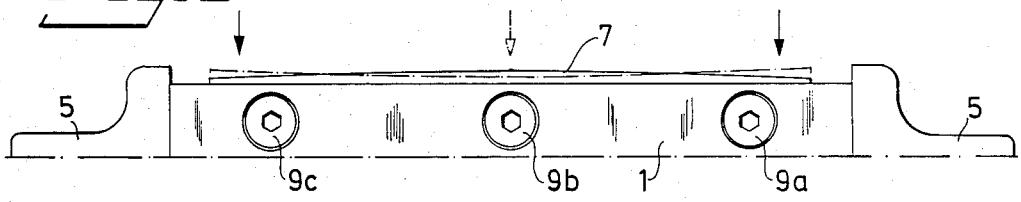
Figure 6:
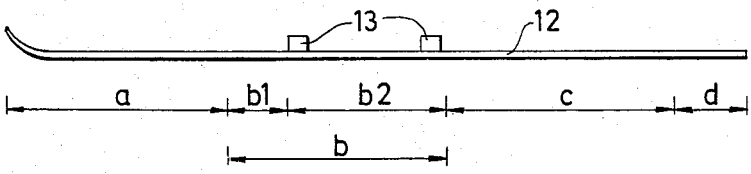

The invention will be illustrated in more detail in the following with regard to one special embodiment thereof with reference to the accompanying drawings wherein FIG. 1 is a perspective view of the file blade side of one embodiment of the sharpening device according to the invention, FIG. 2 is a perspective view of the cutting blade side of the sharpening device of FIG. 1, FIG. 3 is a side elevation of the device in FIG. 1 viewed from the remote end of the figure, FIG. 4 is a sectional view taken along A—A in FIG. 3, FIG. 5 is a schematic view of the bottom portion in FIG. 3 in order to illustrate the adjustability of the cutting blade, and FIG. 6 is a schematic view illustrating an example of division of a ski into different sections having the sliding surface thereof differently scraped or smoothed.

The sharpening or trimming device according to FIG. 1–5 comprises a holder plate 1 of essentially rectangular cross section. The holder plate 1 on one side thereof (FIG. 1) carries two file blades 2, for example of the so-called pansar blade type. The file blades 2 are disposed in recesses or grooves 3 extending along two opposite side edges of the plate and being arranged from these side edges and a distance towards the centre of the plate. The recesses 3 have such a depth that the file blades project a distance above the surface of the plate, as is best seen in FIG. 3. The file blades 2 are fixed against the inner edge 4 of the recesses 3 by means of two handles or thumb grips 5 on both sides of the plate along the file blades. To this end the side edges 4 of the recesses 3 are inclined so that the recesses are broadest at the bottom thereof. The upper part of the handles 5, which contacts the file blades 2, is designed in corresponding manner, so that the file blades 2 are squeezed or clamped in the groove when the handles 5 are applied against the side edges of the holder plate 1 and secured to the holder plate by means of screws, for example two Allen screws in each end of the handles 5, extending through bores in the handle and engaging corresponding threaded bores in the plate member 1.

The file blades 2 may also be fixed in the recesses 3 by countersunk screws, e.g. two for each blade, through borings in the file blades, as is indicated by dashed line screws 14 and borings 15 in FIG. 1 and 3. In such a case the above recess side edges 4 need, of course, not be inclined, no clamping action being necessary.

The handles 5 are, as shown, preferably somewhat higher than the plate 1, so that their portions contacting the plate project a distance on both sides of the plate. The sharpening device will then rest on the handles when leaving the sharpening device with the file blades 2 downwards. The distance between the file blades 2 is adapted such that the file blades shall contact the steel edges of the skis to be sharpened when the sharpening device is placed on a ski with the file blades 2 in alignment with the longitudinal direction of the ski. The steel edges should substantially contact the inner edges of the file blades 2, so that the major part of the base is left unaffected. When these portions of the file blades 2 have been worn-out the file blades can be turned in the recesses 3 so that instead the opposite unworn side edge will contact the steel edges. Normally the file blades have a sharpening or filing surface on both sides of the blades, which means that the file can be used in four different positions before having to be discarded. Hereby the respective file blade 2 can thus be used longer than is the case with conventional sharpening methods.

On the opposite side of the holder plate 1 (FIG. 2) a cutting blade 7 is arranged in a vertical groove 8 extending across the holder 1 at one end portion thereof and perpendicular to the longitudinal direction of the file blades 2. The cutting blade or cutter 7, which may project e.g. some mm above the holder side face, is in the shown case secured in the groove 8 by means of three screws 9, such as Allen screws, each arranged in a threaded bore 10 in the holder plate. Beyond the cutting blade 7 a groove or recess 11 is provided in the holder plate 1 along the cutting blades 7 and the recess 8.

The length of the cutting blade 7 is adjusted such that it is somewhat smaller than the distance between the inner edges of the steel edges in order not to contact the steel edges when smoothing or scraping the base material. Since the groove 8 extends over the entire holder plate 1, cutting blades 7, which are adjusted to different ski types, can be inserted into the groove. As mentioned above the handles 5 project above the holder plate 1 and cutting blade 7, so that the sharpening device rests on the handles when being placed on a support with the cutting blade downwards.

As appears from FIG. 4 the cutting blade 7 may in the normal position be located at a certain distance from the bottom of the groove 8. This permits a certain adjustability of the contour or profile of the cutting edge of the cutting blade 7 projecting above the plane of the holder plate 1, as is somewhat exaggeratedly shown in FIG. 5. In the normal position the cutting edge of the cutting blade 7 is then parallel to the side surface of the holder plate 1. This position, which thus gives a planar base contour, is shown in, e.g., FIG. 3. In FIG. 5 a convex arch contour of the cutting blade is shown in solid lines. This is obtained by first loosening, for example, the screw 9*a*, pressing the cutting blade 7 downwards in the direction of the solid line arrow and fixing this portion of the cutting blade in that position. In corresponding manner the screw 9*c* is then loosened, whereupon the cutting blade is pressed downwards in the direction of the solid line arrow and is fastened by screwing. The cutting blade 7 then obtains the shown convex shape. If one instead loosens the screw 9*b*, presses the cutting blade in the direction of the dashed line arrow and then secures the cutting blade in this position by means of the screw 9*b*, the cutting edge will get the concave profile shown in dashed lines in FIG. 5. Preferably an adjustable screw 16 is countersunk in a central boring 17 extending from the opposite side of the plate 1 to the groove 8 to act upon the lower end of the cutting blade 7 in the central part thereof. This facilitates the forming of the desired cutting blade contour, and, for example, to obtain a convex arch contour screw 9*b* is loosened, screw 16 turned to press the blade 7 upwards and screw 9*b* retightened. As mentioned earlier it is not the question of any major bendings of the cutting blade, but usually variations from a few hundreds to at most about one tenth of a mm. Therefore, the dimensions and material of the cutting blade are not per se critical. A suitable material for the cutting blade is e.g. high speed steel.

The holder plate 1 can be made of steel or cast iron, which gives the sharpening tool an advantageous weight. The handles 5 can be made of the same material, but e.g. plastics or aluminium may be preferred from the view-point of manufacturing technique.

The above described ski sharpener is used in the following way. The ski to be treated is clamped in a vice or the like with the sliding surface upwards. Then the sharpening tool is placed with the file side thereof shown in FIG. 1 facing the ski, so that the file blades 1 are above the steel edges in the longitudinal direction of the ski. Both hands are placed on the two handles 5 so that the fingers contact both the handles and the ski, and the tool is then moved back and forth in the longitudinal direction of the ski until the steel edges have been sharpened sufficiently or possible damages been ground down. Thanks to the weight of the sharpening device (if the holder plate 1 is made of, for example, cast iron or steel) one does not have to press it against the ski. Thereby a very smooth sharpening surface can be obtained in a simple manner. Burrs formed are then removed by means of a separate file. At the same time the edges are usually somewhat rounded in the front part of the ski (from about 2 dm from the front binding point to the ski-tip and the last decimeter of the rear part of the ski). When the steel edges thus have been plane-ground to the desired extent the profile of the cutting edge of the cutting blade or cutter 7 is adjusted to planar, convex or concave shape as has been explained above in connection with FIG. 5. The sharpening device is then placed on the ski surface with the cutting blade 7 between the steel edges, the hands are put on the handles 5 in the same manner as above and the sharpening device is drawn in the longitudinal direction of the ski along the base portion to be scraped to the desired planar, convex or concave shape. When scraping the base the sharpening device is moved in a direction such that the cutting blade 7 is behind the recess or groove 11, wherein scraped base material is collected.

In FIG. 6 there is schematically shown, for a ski 12 having bindings 13, different sections along the ski where the base usually is given different shapes or contours. Thus, the base distance a, which extends from about 2 dm from the front binding and to the tip, is always scraped to a convex or planar shape, but never to concave shape, this in order to prevent the front part of the ski from jamming or catching during running. The distance b from the portion a and to the rear binding is scraped to planar shape. On an icy surface or on hard snow the distance b1 of the distance b (from a to the front binding) can, however, be scraped planar, whereas the distance b2 (underneath the binding) is scraped concave. The distance c+d, i.e. from the rear binding to the rear end, is always scraped planar. As mentioned above the edges of the last decimeter of the ski, or the distance d, are, however, usually ground somewhat round in order not to catch when running. The more exact design of the ski sharpening and scraping can, however, vary from case to case depending on the individual properties of the skier. The use of the sharpening device according to the invention for preparing a slalom ski according to the above reduces the time of preparation considerably. The preparation of skis in conventional manner, which besides only can be done by a skilled and experienced person, usually takes 1½ to 2 hours. With the sharpening device according to the invention the time is reduced to from 10–15 minutes up to about 45 minutes, depending on the experience in ski sharpening of the person performing the sharpening operation. However, with the sharpening device according to the invention an excellent result of the preparation can be obtained even by a non-experienced person.

Turning of the file blades 2 and replacement of worn-out grinding or file blades, respectively, is simply done by loosening the handles 5 by means of the screws 6 (and, if the file blades are screwed to the plate 1, unscrewing the screws 16), turning the file blade or alternatively inserting a new one and then resecuring the handles with the file blades in place (and possibly rescrewing the screws 16). Replacement of the cutting blade can be done after the screws 9*a*–9*c* have been loosened.

The invention is, of course, not limited to the embodiment described above and specifically shown in the drawings. For example, the ski sharpener can be provided with stationary handles, and the securing of the file blades 2 in the recesses 3 can then be done by making the portion between the two file blades 2 removable, as is indicated with the dashed lines in FIG. 3, the removable portion being designated with 1*a*. Securing of the middle portion 1*a* in the plate 1 can preferably be done by means of countersunk Allen screws (not shown). As an alternative the same fixing device for the file blades 2 can be used in combination with removable handles, in which case the recesses 3 do not extend all the way out to the outer edge of the plate. Other changes and modifications of the ski sharpening device can, of course, be done without deviating from the basic idea of the invention, as it is defined in the subsequent claims.

What is claimed is:

1. A device for sharpening the edges and scraping the base of skis, comprising a substantially plate-shaped holder body, which on one side thereof carries two parallel and spaced apart file blades arranged in the same plane, and which on the opposite side thereof carries a cutting blade arranged in the transverse direction of said file blades and substantially crosswise to the plane of the file blades, adjustment means to vary the distance of the cutting blade edge from the holder body surface along the cutting blade.

2. A device according to claim 1, wherein the holder body comprises handles arranged on the sides thereof along said file blades.

3. A device according to claim 2, wherein the holder body comprises a plate which on one side surface thereof is provided with two parallel recesses for the file blades.

4. A device according to claim 3, wherein the file blades are screwed to said plate.

5. A device according to claim 3, wherein the recesses for the file blades in the transverse direction thereof extend to the side edge of said plate, the handles being removably fixed to the plate and arranged to clamp the file blades in said recesses.

6. A device according to claim 3, wherein the cutting blade is arranged in a vertical groove in said plate.

7. A device according to claim 6, wherein the cutting blade is fixed in said groove by means of at least three screws extending through horizontal bores in the plate into the groove, and clamping the cutting blade against one groove side.

8. A device according to claim 7, wherein said adjustment means comprises an adjustable screw arranged in a vertical bore opening into the bottom centre of the groove to effect vertical adjustment of the central part of the cutting blade.

9. A device according to claim 3, wherein the plate is made of a heavy material.

10. A device according to claim 9, wherein said heavy material is steel or cast iron.

11. A device according to claim 6, wherein a recess extending along the cutting blade is arranged in the side surface of the plate in front of the cutting blade as seen in the scraping direction.

12. A device according to claim 2, wherein the handles comprise portions, which on either side of the holder body vertically extend above the planes of application of the file blades and the cutting blade, respectively.

* * * * *